US006094944A

United States Patent [19]

Schmidt

[11] Patent Number: 6,094,944

[45] Date of Patent: Aug. 1, 2000

[54] CUTTING APPARATUS IN A PILE FORMING TEXTILE MACHINE

[75] Inventor: Walter Richard Schmidt, Krems, Austria

[73] Assignee: Adtec Services Limited, Virgin Islands (Br.)

[21] Appl. No.: 08/952,761

[22] PCT Filed: May 17, 1996

[86] PCT No.: PCT/EP96/02145

§ 371 Date: Feb. 26, 1998

§ 102(e) Date: Feb. 26, 1998

[87] PCT Pub. No.: WO96/36753

PCT Pub. Date: Nov. 21, 1996

[30] Foreign Application Priority Data

May 19, 1995 [DE] Germany ..... 195 18 490

[51] Int. Cl.[7] ..... D04B 9/12

[52] U.S. Cl. ..... 66/92; 66/90; 66/93

[58] Field of Search ..... 66/92, 90, 93, 66/9 R

[56] References Cited

U.S. PATENT DOCUMENTS

| | | | |
|---|---|---|---|
| 3,041,859 | 7/1962 | Anderson et al. | 66/92 |
| 3,879,962 | 4/1975 | Mahler | 66/92 |
| 4,127,013 | 11/1978 | Nuber | 66/92 |
| 4,592,212 | 6/1986 | Schmidt | 66/91 |
| 5,463,882 | 11/1995 | Yeh . | |

FOREIGN PATENT DOCUMENTS

| | | |
|---|---|---|
| 0 082 538 | 6/1983 | European Pat. Off. . |
| 1 585 051 | 8/1969 | Germany . |
| 94 00 519 | 3/1994 | Germany . |
| 1585051 | 2/1981 | United Kingdom . |
| 2 289 479 | 11/1995 | United Kingdom . |

*Primary Examiner*—Andy Falik
*Attorney, Agent, or Firm*—Pillsbury, Madison & Sutro LLP

[57] ABSTRACT

A pile forming textile machine (circular knit, tufting, raschel, stitch-bonding or needle punch machine) is equipped with a plurality of pile elements (1, 11, 21, 31, 41, 51, 61, 71) drawing out pile loops from pile yarns or fibers incorporated into a ground fabric and controlling this pile loops to be severed from a cutting apparatus comprising a plurality of pile elements (2, 12, 22, 32, 42, 52, 62, 72) each cooperating with one (of the plurality) of said pile elements by reciprocating movement of said cutting elements transversally to and from said pile elements, each provided with a cutting edge (1*c*, 11*c*, 21*c*, 31*c*, 41*c*, 51*c*, 61*c*, 71*c*) cooperating with a cutting edge (2*c*, 12*c*, 22*c*, 32*c*, 42*c*, 52*c*, 62*c*, 72*c*) one each of said cutting elements which will contact one another in a point by a lateral (β) and a longitudinal (α) inclination, whereby the longitudinal inclination (α) of said cutting elements is obtained by a pressured arrangement of said cutting element by their location in their mounting on a side adjacent to the noncutting (inactive) flank of said cooperating pile element.

7 Claims, 4 Drawing Sheets

Fig. 4
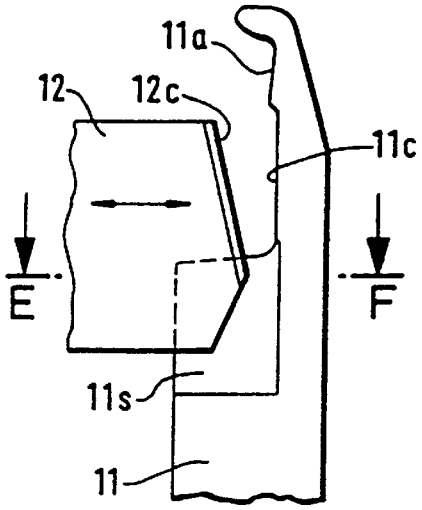
Fig. 6
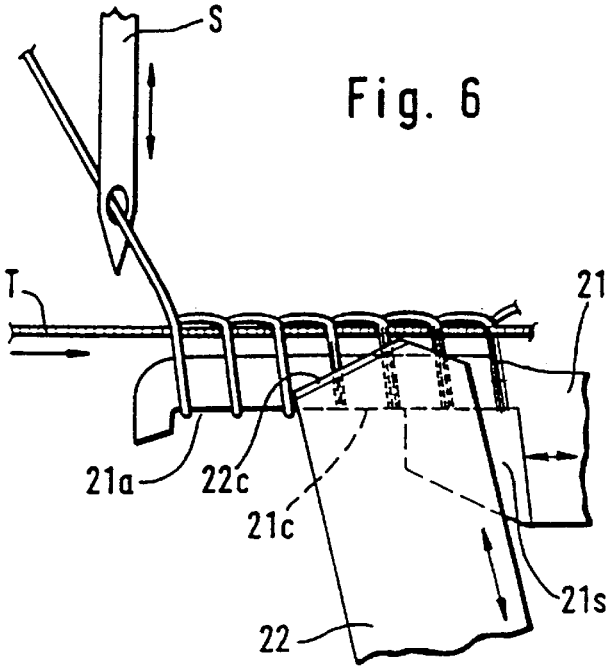
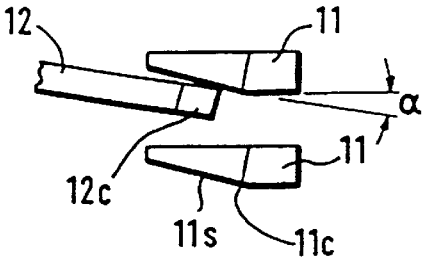
Fig. 5
Fig. 7
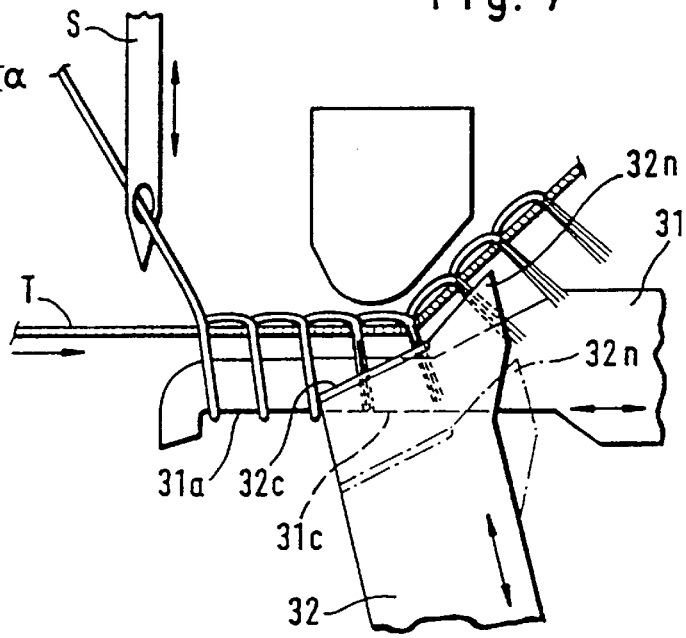

Fig. 10
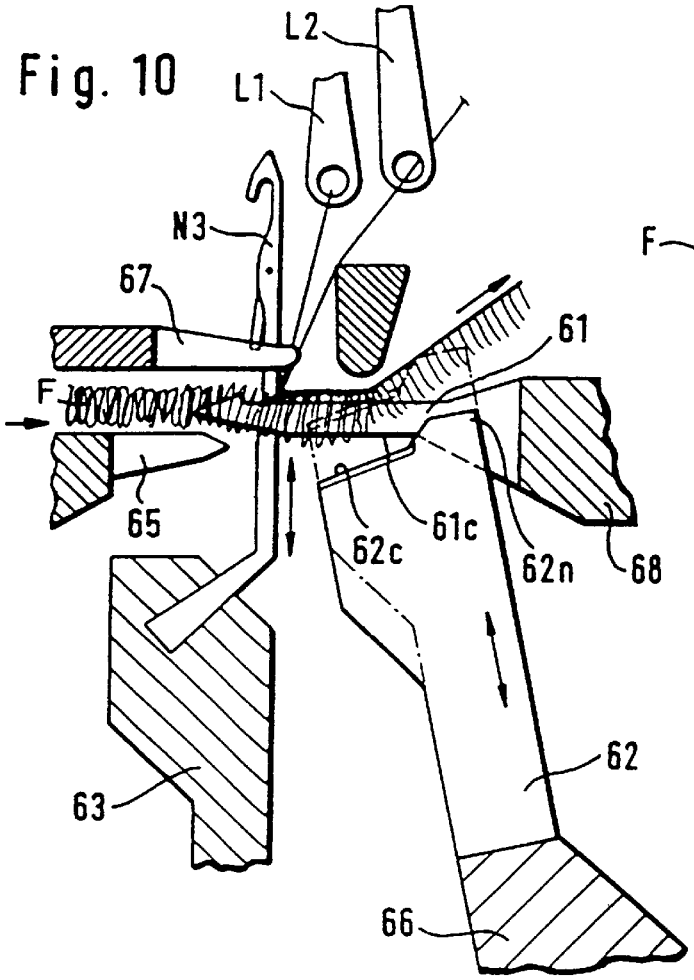
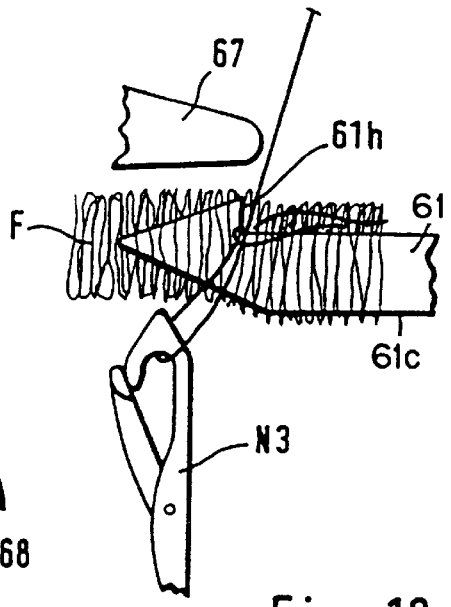
Fig. 10a
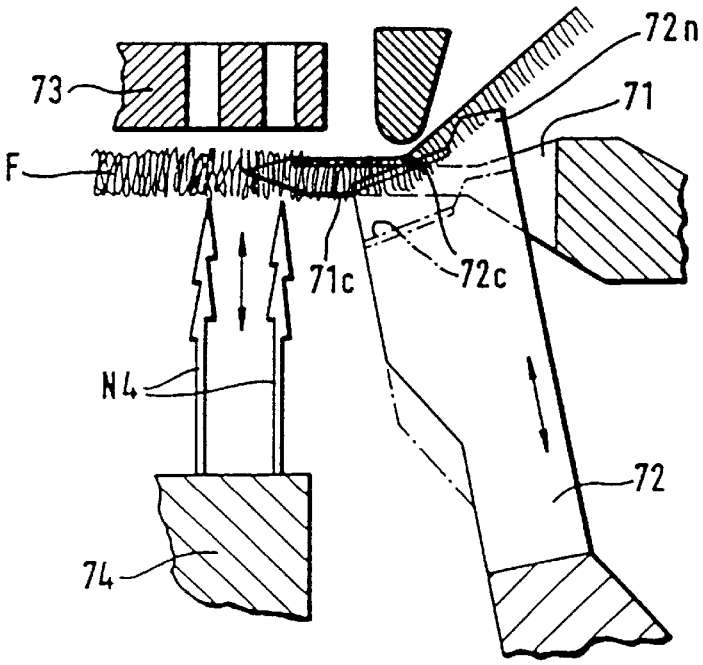
Fig. 11

CUTTING APPARATUS IN A PILE FORMING TEXTILE MACHINE

BACKGROUND OF THE INVENTION

1. Field of the Invention

In manufacturing velour-like textiles, the process of severing pile loops in pile forming machines is of considerable economical and ecological importance, inasmuch as the subsequent shearing of loops necessarily results in considerable loss of pile material. Such losses can be avoided by producing cut pile textiles.

2. Description of the Prior Art

In the past, a plurality of methods for manufacturing cut pile textiles have been developed. Regardless of the type of materials being used to make the product, however, only those methods which severed pile loops by two cutting edges, cooperating in a scissor-like manner, were successful under practical conditions.

Early proposals of this type of mechanism for manufacturing cut pile fabrics on loopwheel machines are described in DE-A-73 161, DE-A-77 975 and DE-A79 328 (corresponding to U.S. Pat. No. 2,579,621). A cutting element is associated with each pile element or sinker. The cutting element is mounted together with or separately from the pile element and is actuated relatively thereto for severing pile loops. The cutting edge of the cutting element is disposed at an angle, usually called an opening angle, with the cutting edge of the pile element, such that both edges are disposed in a V-like configuration prior to the cutting movement which brings them together like a pair of scissors.

This basic concept was subsequently transferred to manufacturing carpets in tufting machines, as described in U.S. Pat. No. 2,335,487, and to the manufacturing cut pile fabrics on circular knitting machines, for example, according to DE-A2-11 53 452 and DE-A2-15 85 051.

Particularly in the case of a laterally adjacent arrangement of pile elements and cutting elements, the cutting movement has been performed with an inadequate side pressure between the cutting edges. Therefore, it is easily possible for the cutting edges of the cutting and pile elements to be deflected by the unsevered pile loops encircling the pile elements. This may happen particularly if the pile loops are tightly enclosed around the pile elements and if the pile yarn is, furthermore, a material having high tenacity and/or abrasion resistance.

In order to obtain increased contact pressure between the cutting elements and the pile elements, and to permit the possibility of setting such contact pressure in accordance with the pile yarn material, the cutting elements on tufting machines were mounted separately from the pile elements and, starting out on the side of the active flank of the pile element, i.e. the flank comprising the cutting edge, were arranged to resiliently contact the latter at a relative inclination or pressurized contact angle.

Since the nibs of the cutting elements contact the pile elements as a result of the inclined arrangement of the cutting elements, a risk is created of obstructing contact between the cutting edges of the cutting elements and the cooperating cutting edges of the pile elements, and the flanks of the cutting elements are also arranged to be inclined with respect to the pile elements. Therefore, prior to the cutting movement, the cutting edges of pile elements and cutting elements have a corresponding overlapping configuration, referenced as a cutting angle, and the elements have only one point of contact. This point of contact shifts during the cutting movement from the lower ends of the cutting edges across their entire length to their upper ends and in the process deflects the overlapping part of the cutting elements from the pile elements. The gap created thereby is to prevent pinching of severed pile loops and deflection of the cutting edges being separated.

Therefore, this cutting angle between the two elements is of particular importance. The cutting angle must be dimensioned to sufficiently separate the elements after the cutting point and to also avoid pinching of pile loops. In tufting machines, the cutting movement is performed by a relative movement of the mounting bar of the cutting elements in parallel with the flanks of the pile elements. A constant contact pressure between the elements is ensured exclusively by an adequate cutting angle in combination with a shallow angle under which the cutting element is pressed against the pile element during the cutting motion.

These same conditions, in combination with a restricted opening between the respective cutting edges, ensured that the flanks of the cutting elements projecting between the pile elements cannot contact the pile elements with their front ends and cause a reduced contact pressure between the cutting edges or even their separation, respectively. As an increased cutting angle will, however, also intensify wear of the cutting edges, and must therefore be avoided, the requirements to the dimensions of cutting, opening and pressurized contact angles are in direct contradiction.

Due to the contact angle of the cutting element to the pile element, the required contact pressure for severing the pile loops is obtained, whereby the cutting elements are flexibly bent. Therefore, the pressurized contact angle is smaller in the area of the cutting edges than in the mounting area as a function of the material thickness.

The thickness of the cutting elements is determined by the gauge and by the thickness of the pile elements. The pile elements must be of a sufficient size that the cutting angle cannot be reduced or neutralized by a deflection of the pile elements as a result of pressurized contact with the cutting elements. The maximum thickness of the cutting elements is, therefore, determined by the gauge and the thickness of the pile elements under consideration of the pressurized contact angle and the cutting angle. To obtain cutting elements having sufficient strength on finer gauge tufting machines, the inactive flanks of the pile elements opposite the cutting edges are partially bevelled to obtain the required space in between the pile elements. Adequate strength of the cutting elements is necessary to avoid torsional forces in the transverse axis of the cutting elements whereby also the cutting angle of the cutting edges may be reduced or neutralized, respectively, and the cutting elements would contact the pile elements with their front ends.

Under the above described conditions it is obvious that owing to adequate contact and cutting angles a reduction of the space in between the pile elements is limited and tufting machines with a gauge of less than 1/10 in. are regarded as a fine gauge machine.

The above described conditions for severing pile loops were applied to a circular knitting machine for manufacturing cut pile fabric according to the proposal of EP-A2-0 082 538 (corresponding to U.S. Pat. No. 4,592,212) keeping in mind consideration of the requirements for a correct fabric construction. In order to permit sufficient dimensions of the pile and cutting elements in view of the reduced space between pile and cutting elements required for the respective usual gauges of 18 or 20 needles per inch, it was necessary to reduce the angles required for the severing operation, especially the pressure contact angle. This was realized by a reduced distance between the cutting edges and the mounting of the cutting elements in the sinker ring.

Owing to the fact that the cutting elements in circular knitting machines are moved in their fixed mounting during the cutting movement, an increased contact pressure resulted even under a smaller pressure contact angle. This increased the possibility of the pile element being deflected in a lateral direction, or the cutting edge of the cutting element being twisted, both of which can cause the above described negative consequences in severing pile loops.

As can be gathered from the foregoing description of the presently applied methods for severing pile loops in pile forming textile machines, satisfactory severing of the pile loops along with a fairly suitable service life for the cutting edges will result only from an extremely precise harmonization of the dimensions of pile and cutting elements and of the contact, opening and cutting angles of these parts. A particular disadvantage resides in the limitation of the range of gauges.

SUMMARY OF THE INVENTION

With the foregoing in mind, it is the object of this invention to reduce wear of the cutting edges by reducing their cutting angle and yet create a maximum spacing or gap by separating the cutting element from the pile element subsequent to the point of severing to thereby avoid pinching pile loops while at the same time realizing finer machine gauges.

These objects are attained, according to the present invention, in that the cutting elements are arranged to extend from a mounting point located on the side of the inactive flanks of the pile elements, i.e. the side opposite the cutting edge thereof, toward and into contact with the active flanks of the pile elements, i.e. the side flank having the cutting edge.

By this surprisingly simple measure all the disadvantages and restrictions of the described anterior proposals are eliminated entirely or at least to a large extent.

Due to the proposed disposition of the cutting elements relative to the pile elements, the angle of pressurized contact between the elements is increased relative to the inclined disposition of the cutting elements in their mounting (sinker-ring) so that subsequent to or beyond the point of severing both elements are separated from each other, thereby preventing a planar contact between their respective facing flanks. In contrast to previous proposals, this mounting and operating arrangement makes it possible to increase the opening angle of the cutting edges and to reduce the contact force.

Despite a substantial reduction of the cutting angle it is also ensured that both elements contact each other in one point only, resulting in a substantially prolonged useful life of the cutting edges and increasing the intervals between replacement. Likewise, shut down periods and related costs are reduced. In addition, the pile and cutting elements may be produced by simpler methods from more economic materials and, therefore, at reduced costs.

The novel disposition of the pile and cutting elements relative to each other requires less space thereby enabling construction of very fine gauge machines with small distances between pile elements and cutting elements. As the reduced cutting angle need not be compensated by increased contact pressure, especially the cutting elements can be dimensioned with a view to better stability. Also the lateral pressure applied by the cutting elements to the pile elements is reduced, and more uniform contact pressure is obtained during the severing action so that undesirable lateral movement or twisting of the elements are greatly lessened or prevented.

The technical progress realized by this invention makes it possible to adopt the pile forming and cutting device into the manufacturing process of velour-like fabrics performed by a variety of methods.

Hereinafter this will be described and demonstrated by reduced and simplified drawings of various embodiments.

Other objects, features, and characteristics of the present invention will become apparent upon consideration of the following description in the appended claims with reference to the accompanying drawings, all of which form a part of the specification, and wherein like reference numerals designate corresponding parts in the various figures.

BRIEF DESCRIPTION OF THE DRAWINGS

FIG. 4 is a partial side elevational view of the pile and cutting elements of a circular knitting machine in accordance with another embodiment;

FIG. 5 is a sectional view along line E–F in FIG. 4;

FIGS. 6 and 7 are partial side elevational views of different designs of pile elements and cutting elements on tufting machines;

FIGS. 9 and 10 are partial side elevational views of an arrangement of pile and cutting elements for manufacturing a velour-like surface from a fiber fleece;

FIG. 10*a* is an enlarged detail view from FIG. 10; and

FIG. 11 is a partial side elevational view of an arrangement of pile elements and cutting elements in a needle-felt machine.

DETAILED DESCRIPTION OF THE PREFERRED EMBODIMENT

Since the manufacture of textiles in accordance with the various methods is known from numerous publications as well as from manuals for the respective machines, the following description is particularly directed to the task of severing pile loops developed from yarns or fibers.

The invention is generally implemented on machines on which yarns or fibers are drawn out to form pile loops. This is performed by the pile forming surfaces at the free ends of the pile elements. In the longitudinal continuation of their pile forming ledges, the pile elements include cutting edges forming a V-shaped mouth with the cutting edges of separate cutting elements prior to any scissor-like cutting movement that will sever the held or retained pile loops.

A corresponding arrangement of pile elements and cutting elements on circular knitting machines is shown in the two embodiments of FIGS. 1 to 5. These are based on a circular knitting machine referred to in EP-A2-0 082 538 and U.S. Pat. No. 4,592,212, respectively, that are hereby incorporated by reference.

Manufacturing pile fabrics by needles N mounted in a dial R and pile elements 1 mounted in the cylinder Z is furthermore known from a multitude of publications. Conventionally, pile yarns are drawn out into pile loops H1 (FIG. 1) over pile forming ledges 1*a* during the knitting step and remain on the pile elements during the subsequent knitting steps while sliding downwardly on the stems of the pile elements, as a result of the take-down action, to the cutting zone constituted by the pile elements 1 and the cutting elements 2.

Figures 1, 2, 3:
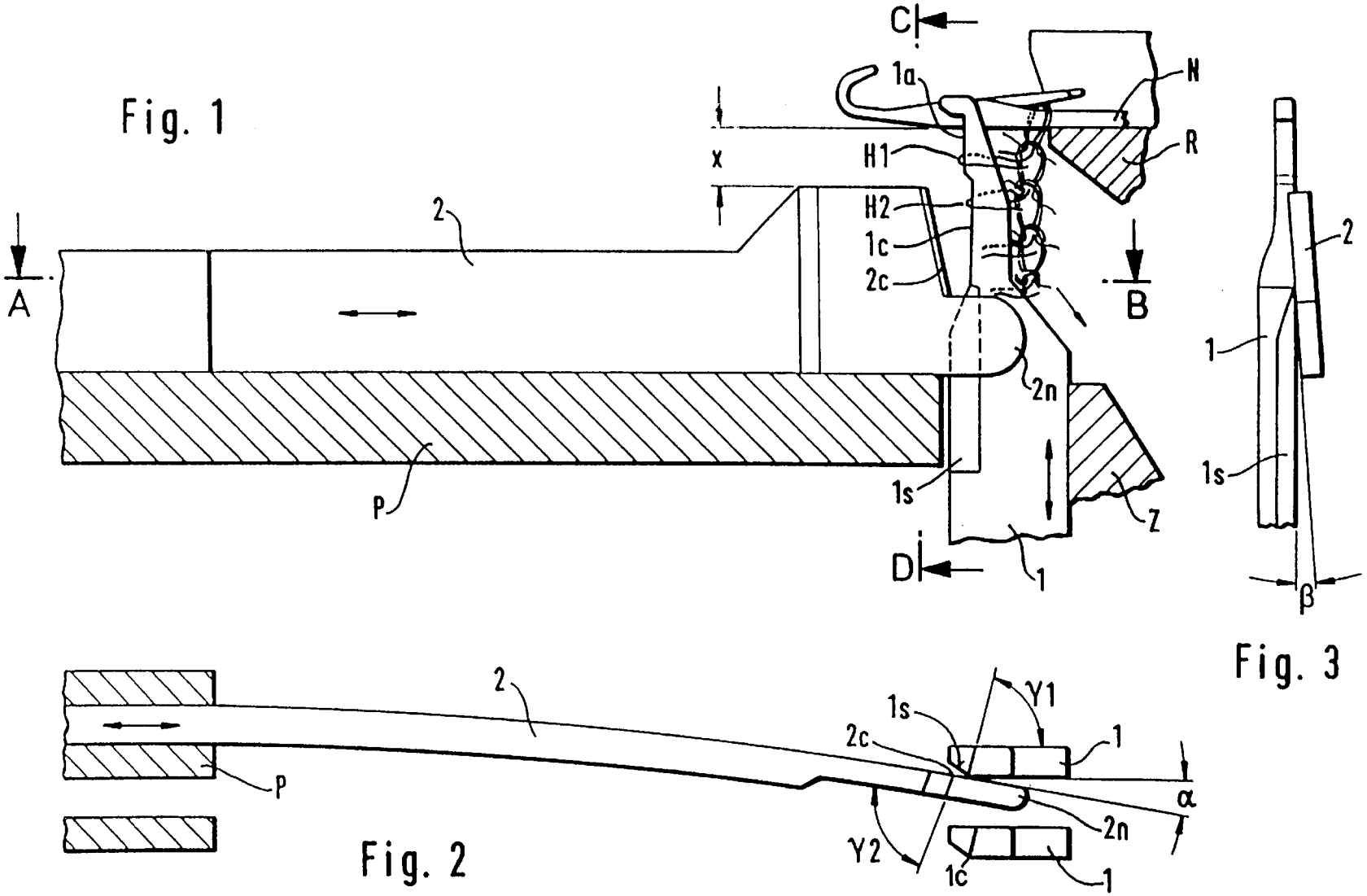
FIG. 1 is a partial side elevational view of the arrangement of pile elements and cutting elements in a circular knitting machine for manufacturing cut pile fabrics.
FIG. 2 is a sectional view along line A–B in FIG. 1.
FIG. 3 is a sectional view along line C–D in FIG. 1.

Cutting zones are formed on the pile elements 1 as a continuation of the pile forming ledges 1*a*, by grinding the lateral cutting flanks of these pile elements at an angle γ1 to form cooperating cutting edges 1*c* (FIG. 2). Sharp cutting edges 2*c* are correspondingly ground at angle γ2 on the cutting elements 2, specifically on their cutting flanks, so that cutting edges 2*c* will contact the pile elements 1 and cutting edges 1*c*. Due to an oblique positioning of the cutting edges 2*c* relative to the substantially vertical cooperating cutting edges 1*c* of the pile elements 1, the facing cutting edges 1*c* and 2*c* form a vertical V-like mouth or an angled upwardly directed angle opening as shown in FIG. 1 (opening angle).

For severing pile loops, the cutting elements 2 are shifted toward pile elements 1 thereby closing the V-like opening between cutting edges 1*c* and 2*c*. By disposing the cutting elements 2 at a distance x underneath the needles N (FIG. 1), it is ensured that at least the pile loops H1 of the last course knitted will not be severed by movement of cutting element 2 since they are still too high on pile element 1. Subsequently, the cutting elements 2 are retracted so that uncut pile loops can slide down pile element 1 into the V-like space between the cutting edges by knitting succeeding courses. The control mechanism for the cutting elements is described in EP-B 0 082 538, the disclosure of which is herewith fully incorporated by reference.

Sufficient lateral contact pressure between the cutting elements 2 and the pile elements 1, to assure severing of the pile loops, is preferably realized by separately mounting the cutting elements 2 and the pile elements 1 (FIGS. 1 and 2). In a circular knitting machine this is preferably effected by mounting in the cutting elements 2 in a sinker ring P which is rotatable in a lateral direction with respect to cylinder Z which supports the pile elements 1.

To generate the lateral contact pressure between the cutting elements 2 and the pile elements 1 according to the invention, the cutting elements 2 are mounted in a sinker ring P. The sinker ring P is itself adjustable in a lateral direction relative to the cylinder Z into a condition in which the flanks of the cutting elements 2, subsequent to contacting the cutting edges 1*c* of the pile elements 1, are moved at an angle α (FIG. 2) relative to the flanks of the pile elements 1 and elastically pressed thereagainst. This necessarily results in formation of a gap between the facing flanks of pile elements and cutting elements, respectively, subsequent to the point of severing, thus preventing pile loops from being pinched. A sufficient angle α of preferably between 2° and 8° ensures that this gap is also preserved if a pile element 1 insignificantly deflects to the side or if the flank of a cutting element 2 is insignificantly twisted. In any case, a planar contact between the respective flanks of the elements is thereby prevented and the effect of concave grinding in a pair of scissors is obtained.

In contrast with previous arrangements of cutting elements and pile elements, the gap formed between the flanks of the elements according to the invention following cutting, is obtained by the inclined disposition of the cutting elements 2 relative to the pile elements 1. The vertical inclination of the flanks of the cutting elements 2 at an angle β relative to the flanks of the pile elements 1 (cutting angle) according to FIG. 3 can be kept smaller than in the known approaches to the problem. This angle β is generated by the correspondingly oblique mounting of the possibly planar cutting elements 2 relative to each other, and/or by correspondingly overlapping disposition of the ranges of the cutting edges. This arrangement increases durability of the cutting edges and reduces stop times of the machines to replace blunted elements along with a reduced consumption of pile and cutting elements.

A further advantage of the arrangement or relative position of the cutting elements 2, according to the invention, resides in the fact that the laterally shifted disposition of the mounting of the cutting elements relative to the contact surface on the pile elements is smaller than in the known proposals so that the cutting angle α required at the point of contact between the elements is realized with a decreased angle in the mounting (sinker ring) or an equivalent solution.

As shown in FIG. 2, even in finer gauge machines, where there is a small distance between the pile elements 1, sufficiently sturdy cutting elements 2 can be arranged between the pile elements 1 while having the required pressurized contact angle α and cutting angle β. Even finer gauges may be obtained if that part of the cutting elements 2 which overlaps the pile elements is reduced in thickness and/or where the nib 2*n* of the cutting elements 2, or a corresponding limiting surface 1*s* on the pile element 1, comprises a bevel-edge.

Preferably, continuous contact exists between the cutting elements 2 with the pile elements 1 (other than during the severing action) through a nib 2*n* shown in FIGS. 1 and 2. If that part of the pile elements 1 below the cutting edge 1*c* nevertheless projects between the cutting elements 2, the relevant portions is, shown FIGS. 1, 2 and 3, must have a greater bevel than at the pressurized contact angle α. Therefore, the elements contact each other exclusively on the cutting edge 1*c* or in the continuation is thereof. Further, the vertical movement of the pile elements 1 on the cutting element 2 produces a self-sharpening effect on the cutting edge 1*c*.

FIGS. 4 and 5 demonstrate an arrangement of pile elements 11, that include pile forming ledges 11*a* and cooperating cutting edges 11*c*, and of cutting elements 12 that have cooperating cutting edges 12*c*. Continuous contact between the elements is ensured by the guide surface 11*s* of the pile element 11 which projects radially outwardly beyond the cutting edges 11*c* and has a bevel surface that is angled a correspondingly greater amount than the cutting angle α. Such a solution is largely reserved for machines having coarser gauges. For finer gauges, the embodiment according to FIGS. 1 to 3 is preferred to largely avoid the bevel-edging of pile elements.

The foregoing described arrangement of individually actuated pile and cutting elements on circular knitting machines according to the invention can also be applied to other textile machines for manufacturing cut pile fabrics.

FIGS. 6 and 7 illustrate the pile elements and cutting elements on a tufting machine for manufacturing velour fabrics. The elements are fixed in bars which are actuated in a well known manner. The needles S, which are arranged in one row or have a staggered arrangement in two rows, penetrate through a ground or backing fabric T to thereby form loops which are engaged by pile forming ledges 21*a* or 31*a* of the respective pile elements 21 and 31. By forming subsequent courses of pile loops, the previously formed pile loops slide along the stems of the pile elements, from left to right in FIGS. 6 and 7, toward a cutting zone. The cutting zone is formed between the cutting edges 21*c* and 22*c* of pile elements 21 and cutting elements 22, respectively, in FIG. 6,.or by cutting edges 31*c* of pile elements 31 and cutting edges 32*c* of respective cutting elements 32 in FIG. 7.

FIG. 6 demonstrates the traditional shape of pile elements 21 and cutting elements 22. To ensure the required inclined disposition of the cutting elements with respect to the pile elements 21, a bevel-edged contacting face 21*s* is necessary according to the above description of FIGS. 4 and 5.

As shown in FIG. 7, the cooperating cutting edge 31*c*, or its continuation on the pile element 31, extends across the cutting element 32. Owing to the corresponding shape of cutting element 32, continuous contact with the pile element 31 is realized by at least one nib 32*n* (shown in dashed lines in the down or retracted condition of cutting element 32). To prevent damage to the ground fabric T by the upward cutting movement of the cutting element 32, a corresponding upwardly angled diversion is provided in the path followed by the ground fabric. In accordance with the description of FIGS. 1 to 3, finer gauges of tufting machines may thereby be obtained.

This arrangement of pile elements and cutting elements for manufacturing cut-pile fabrics is also suitable for other textile machines.

Figure 8:
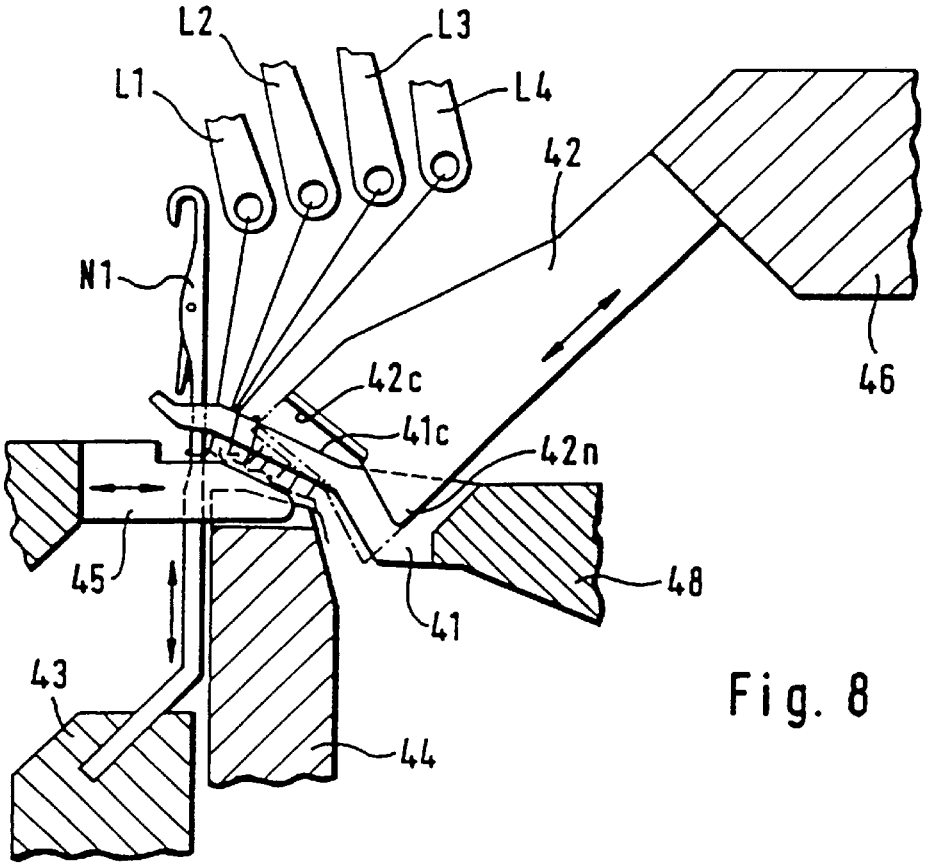
FIG. 8 is a partial side elevational view of an arrangement of pile and cutting elements in a pile forming warp-knitting or raschel machine in a lateral view.

For example in FIG. 8 a possibility of manufacturing a cut-pile fabric on a warp-knitting machine or on a raschel machine is illustrated. The production of uncut loop fabrics on such machines is known. In contrast with the previous methods for knitting a cut-pile fabric, the bar 48 for the pile elements 41 has to be moved and controlled independently of the guide bars L1 to L4. The pile elements 41 may be arranged between the needles N1 either permanently, or only temporarily when the stitching process with the simultaneous forming of pile loops is performed. Furthermore, a lateral shifting of the pile elements 41 together with their bar 48, the cutting elements 42 and their bearing in the bar 46 may be provided.

The pile yarns of at least one of the shown guide bars L1 to L4, with the number of guide bars depending upon the machine layout, are engaged by the pile elements 41 and drawn out over the elements into pile loops. As knitting continues, the pile loops will continue to slide along the pile elements 41 toward and into a cutting, zone of pile cutting edges 41*c*. For severing such pile loops, cutting elements 42 are actuated towards the pile elements 41. This movement of the cutting edges 42*c* toward pile cutting edges 41*c* closes the space that existed therebetween. Due to the inclined arrangement of the cutting elements 42 with respect to the pile elements 41, as described for the previous embodiments, the pile loops that have slipped between the cutting edges 41*c* and 42*c* are severed. The actuation of cutting elements 42 to the pile elements 41 is performed, in analogy with the art known from tufting machines, to realize a continuous contact of the elements at least by a nib 42*n*.

As is also known, additional weft yarns may be inserted into the ground fabric.

An alternative is the incorporation of a fibre fleece into the ground fabric simultaneously with the knitting action. This would remove the necessity of subsequently laminating a pile fabric with a fleece material.

Figure 9:
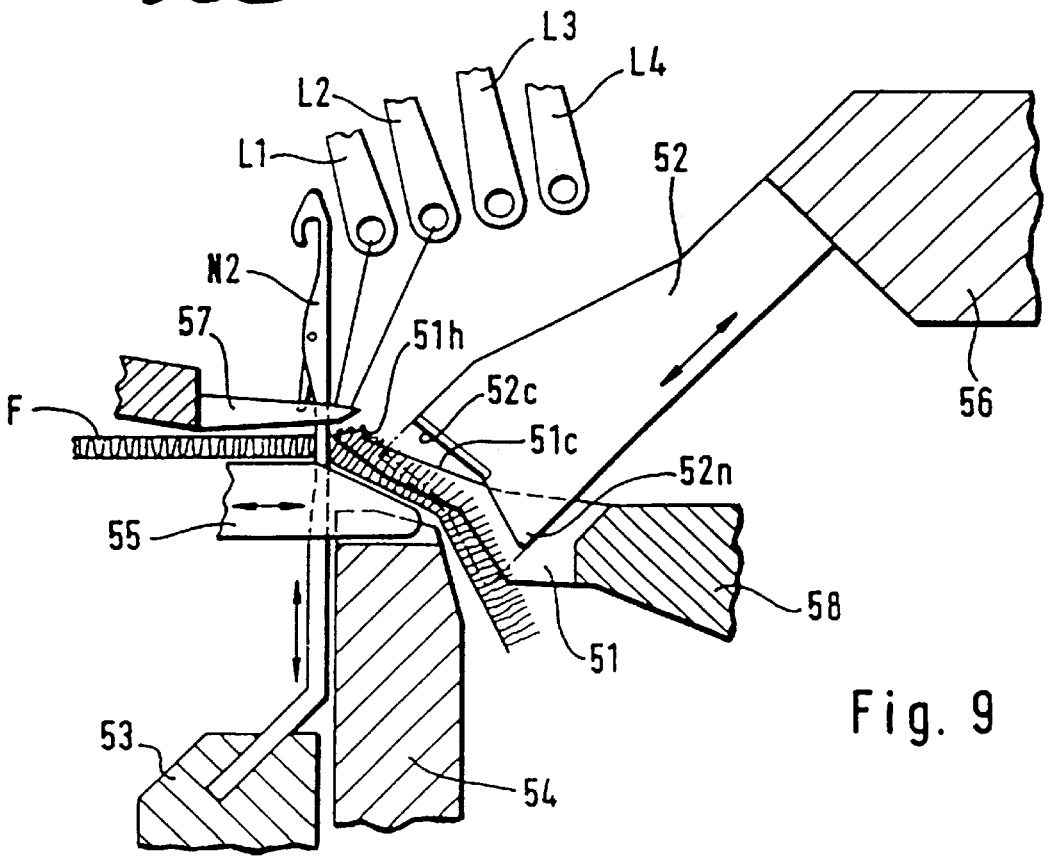

When consolidating a fiber fleece into the ground fabric on a raschel or stitch-bonding machine, it is also possible to produce pile loops, at least from a part of fibers of the fleece, by lapping such fibers round a pile element and to sever these pile loops by means of a cutting element. A respective proposal is illustrated in FIG. 9. Pile elements 51 and cutting elements 52 are mounted in bars 58 and 56, respectively, and are actuated as described for the above described embodiment.

A loose fleece F of staple fibers is supplied in the known manner for example from feeding sinkers 55 into the range of needles N2 which penetrate through the fleece F in their rising movement. Simultaneously, the pile elements 51 penetrate into the loose fleece F. After the binding yarns supplied by at least one guide bar L1–L4 have been lapped into the needle hooks, the needles N2 are retracted into the knockover position. Previously, the sinker bar 57 and the pile bar 58 with the pile elements 51 will have been retracted, whereby the pile element hooks 51*h* draw pile fibers onto the pile elements 51. These loops are finally incorporated by the knitted binding yarns and slide along the pile elements 51 until they are severed by the cutting movement of the cutting elements 52 between the cooperating cutting edges 52*c* and 51*c* of the cutting and pile elements, respectively. In this case, a velour-like surface of severed pile fibers is obtained on the left-hand side, i.e. the side opposite the stitch side.

The velour-like surface of severed pile fibers can also be realized on the stitch side of the fabric; a respective embodiment is shown in FIG. 10.

As referred to above, a fiber fleece F is supplied into the machine and is penetrated by the pile elements 61 in a longitudinal direction. Between the pile elements 61 the needles N3 penetrate through the fleece F to engage the binding yarns from at least one guide bar L1 or L2, respectively, which consolidates the fleece. Simultaneously, lapping loops from pile fibers are formed over the pile elements 61 as shown in FIG. 10*a*. The transportation of the looped fabric is supported by the hooked shape 61*h* of the pile elements 61. The lapped fiber loops on the pile elements 61 then slide along the pile element into the cutting zone where the loops are severed by the cutting edges 62*c* of cutting elements 62 that cooperate with cutting edges 61*c* of the pile elements 61 in accordance with the inclined relative arrangement of the invention.

To avoid a longitudinal orientation of the velour-like surface of the fabric in the embodiments of FIGS. 9 and 10, a reciprocating racking of the fleece may be carried out in conjunction with feeding of the fleece.

According to well-known methods of stitch-bonding (for example Mali fleece), it is not necessary to use binding yarns. By use of adequate needles and their actuation, the consolidation of a fleece is accomplished by knitting loops from a part of the fibers from the fleece. Simultaneously, the forming of pile loops from another part of the fibers, which are subsequently severed, can be accomplished under comparable conditions to the embodiments of FIGS. 9 or by an inclination of the cutting edges according to the invention.

The description of the foregoing embodiments also demonstrates that the consolidation of a fleece by forming pile loops simultaneously is not restricted to methods in which stitches are formed.

In FIG. 11 the consolidation of a fleece on a needle punch machine is shown in a simplified manner. The felting needles N4 are arranged in the movable bar 74 and penetrate the supplied fleece F, consolidating the fleece in cooperation with a perforated plate 73. The pile elements 71 are actuated at least into a part of the working area of the felt needles, picking up pile fibers to form pile loops thereof. In the further course of production, the pile loops are transported into the cutting zone and severed there by a corresponding cutting movement of the cutting edges 72*c* of the cutting elements 72 which, according to the invention, are positioned at an inclination relative to the cutting edges 71*c* of the pile elements 71.

The present embodiments illustrated and described herein exclusively demonstrate fundamental possibilities for manufacturing cut pile fabrics in accordance with different methods of producing textile fabrics. These methods are modifiable in accordance with the disposition of the elements forming or processing a ground fabric and pile loops. The invention preferably employs cutting elements 2, 12, 22, 32, 42, 52, 62 and 72 that are inclined relative to the pile elements 1, 11, 21, 31, 41, 51, 61 and 71 as illustrated and described according to FIGS. 1 and 3, thereby forcibly guiding the cutting elements away from the pile elements at an angle $\alpha$ subsequent to the point of contact of the cutting edges.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A pile-forming textile machine comprising:

a ground fabric supply assembly;

a plurality of pile elements operatively mounted to permit formation of loops of pile threads or fibers; and a corresponding number of cutting elements each being operatively positioned and in pressure contact relative to a corresponding individual one of said plurality of pile elements at a pressure contact angle ($\alpha$) and a cutting angle ($\beta$), each of said cutting elements including a cutting edge for severing pile loops positioned on the corresponding individual one of said plurality of pile elements;

wherein each of said plurality of pile elements cooperating with a cooperating cutting edge for severing pile loops positioned thereon;

wherein each of said cutting elements extends from a mounting location on a side adjacent to a noncutting flank of said corresponding individual one of said plurality of pile elements and into pressurized contact with the cutting flank thereof; and wherein a portion of said cutting elements remains contact with the cutting flank.

2. A pile-forming textile machine as in claim 1 wherein the contact is provided by at least one guiding nib projecting from said cutting edge towards said pile element.

3. A pile-forming textile machine according to claim 2 further including a guiding portion provided on said pile element opposite a free end thereof.

4. A pile-forming textile machine as in claim 3 wherein said guiding portion comprises an angled surface.

5. A pile-forming textile machine according to claim 3 said guiding portion comprises a bevelled surface which prevents contact between said pile element and said cutting element therealong and permits said cutting element to glide along the edge of said guiding portion adjacent said cooperating cutting edge.

6. A pile-forming textile machine according to claim 1, wherein the pressure contact angle is preferably between 2 to 8 degrees.

7. A pile-forming textile machine according to claim 1, wherein the pressure contact angle is preferably between 2 to 8 degrees.

* * * * *